US011662074B1

(12) United States Patent
Jin

(10) Patent No.: US 11,662,074 B1
(45) Date of Patent: May 30, 2023

(54) VEHICLE LAMP HAVING A MIXING LENS AND PLURALITY OF SPACED APART OPTICAL MODULES

(71) Applicant: HYUNDAI MOBIS CO., LTD., Seoul (KR)

(72) Inventor: Min Ji Jin, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/660,796

(22) Filed: Apr. 26, 2022

(30) Foreign Application Priority Data

Feb. 7, 2022 (KR) ..... 10-2022-0015308

(51) Int. Cl.
*F21S 41/26* (2018.01)
*F21S 41/151* (2018.01)

(52) U.S. Cl.
CPC ..... *F21S 41/26* (2018.01); *F21S 41/151* (2018.01)

(58) Field of Classification Search
CPC ..... B60Q 1/0041; B60Q 1/0047; F21V 5/008; F21S 41/26
See application file for complete search history.

(56) References Cited

U.S. PATENT DOCUMENTS

| | | | | |
|---|---|---|---|---|
| 9,416,935 | B2 * | 8/2016 | Watanabe | B60Q 1/38 |
| 9,976,719 | B2 * | 5/2018 | Nishimura | F21S 41/285 |
| 11,287,100 | B2 * | 3/2022 | Potter | F21S 41/265 |
| 2005/0254253 | A1 * | 11/2005 | Yeh | F21S 41/255 362/514 |
| 2008/0151567 | A1 | 6/2008 | Albou | |
| 2017/0030543 | A1 | 2/2017 | Gromfeld et al. | |
| 2018/0087732 | A1 | 3/2018 | De Lamberterie et al. | |

FOREIGN PATENT DOCUMENTS

| | | |
|---|---|---|
| JP | 2014-086306 | 5/2014 |
| KR | 10-1713159 | 3/2017 |

OTHER PUBLICATIONS

English Language Abstract of JP 2014-086306 published May 12, 2014.
Extended European Search Report dated Oct. 7, 2022 issued in EP 22171801.8.

* cited by examiner

*Primary Examiner* — Robert J May
(74) *Attorney, Agent, or Firm* — DLA Piper LLP (US)

(57) ABSTRACT

A vehicle lamp may include a plurality of optical modules and a mixing lens for mixing light emitted from each optical module in front of the plurality of optical modules, thereby freely designing an optical system without restrictions according to a shape of a lamp, and at the same time, realizing a uniform light emitting image in a form of a surface light source.

13 Claims, 12 Drawing Sheets

VEHICLE LAMP HAVING A MIXING LENS AND PLURALITY OF SPACED APART OPTICAL MODULES

CROSS-REFERENCE TO RELATED APPLICATION(S)

This application claims benefit of priority to Korean Patent Application No. 10-2022-0015308 filed on Feb. 7, 2022 in the Korean Intellectual Property Office, the disclosure of which is incorporated herein by reference in its entirety.

BACKGROUND

Field

The present disclosure relates to a vehicle lamp, and more particularly, to a vehicle lamp capable of freely designing an optical system without restrictions according to a shape of the lamp, and at the same time, realizing a uniform light emitting image in a form of a surface light source.

Description of Related Art

In general, head lamps are installed on both sides of a front of a vehicle. The head lamp includes a low beam light source unit and a high beam light source unit. The head lamp implements a light function that may form a specific pattern around a vehicle or on a road surface.

The head lamp includes a reflector that reflects light emitted from a light emitting diode (LED), and a shield unit that separates the light reflected from the reflector into a low beam and a high beam. The low beam and high beam are irradiated to the front of the vehicle through an aspherical lens.

Conventionally, however, since a light distribution pattern is formed by applying a short-focal aspherical lens to a head lamp, there is a limit to realizing the design of the head lamp. In addition, in order to realize a slim image, upper and lower end portions of the aspherical lens are cut and used. In this case, since a thickness of an optical lens increases as a diameter of the aspherical lens increases, a size and weight of an optical module may increase.

Accordingly, there is a demand for development for simplifying a structure and manufacturing process and improving design characteristics of the head lamp.

RELATED ART DOCUMENT

[Patent Document]

(Patent Document 1) Korea Patent No. 1713159 (registered on Feb. 28, 2017)

SUMMARY

An aspect of the present disclosure may provide a vehicle lamp including a plurality of optical modules and a mixing lens for mixing light emitted from each optical module in front of the plurality of optical modules to freely design an optical system without restrictions according to a shape of the lamp, and at the same time, realize a uniform light emitting image in a form of a surface light source.

According to an aspect of the present disclosure, a vehicle lamp may include a plurality of optical modules each emitting light and spaced apart from each other, and a mixing lens arranged in front of the plurality of optical modules and mixing the light emitted from each of the plurality of optical modules to form a light emitting image in a form of a surface light source.

The mixing lens may be curved backward from an in-board side along an out-board side.

A curvature of the mixing lens may increase from the in-board side to the out-board side.

The mixing lens may be configured so that light passing through the mixing lens becomes parallel light within 1° in an entire area in a horizontal direction.

In the mixing lens, an entrance surface on which the light emitted from the optical module is incident may be formed to be concave, and an exit surface on which the light passing through the mixing lens is emitted may be formed to be convex, and a thickness of the mixing lens may decrease from the in-board side to the out-board side, and a curvature of the entrance surface and a curvature of the exit surface may increase from the in-board side to the out-board side.

The mixing lens may be configured so that light passing through the mixing lens becomes parallel light within 1° in an entire area in a vertical direction.

In the mixing lens, an entrance surface on which the light emitted from the optical module is incident may be formed to be concave, and an exit surface on which the light passing through the mixing lens is emitted may be formed to be convex, and in the mixing lens, a curvature of the entrance surface may be larger than that of the exit surface at all positions.

The plurality of optical modules may include at least one first optical module and at least one second optical module, and a main lens of the first optical module and a main lens of the second optical module may be formed of different types of lenses.

The first optical module may be arranged on the in-board side, and the second optical module may be arranged on the out-board side, and the main lens of the first optical module may be a concave lens, and the main lens of the second optical module may be a convex lens.

In the main lens of the first optical module, an entrance surface and an exit surface may be concave in a horizontal direction and convex in a vertical direction, respectively, and in the main lens of the second optical module, an entrance surface and an exit surface may be convex in a horizontal direction and convex in a vertical direction, respectively.

A shield of the first optical module may be positioned at a vertical focus position of the main lens of the first optical module.

A horizontal focus and a vertical focus of the main lens of the second optical module may be formed at the same position.

A shield of the second optical module may be positioned at a horizontal focus position or a vertical focus position of the main lens of the second optical module.

The mixing lens may be a single lens.

The vehicle lamp may further include an outer lens arranged in front of the mixing lens, in which a curvature of an entrance surface of the outer lens may be formed to be the same as that of an exit surface of the mixing lens.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described with reference to the accompanying drawings.

Figure 1:
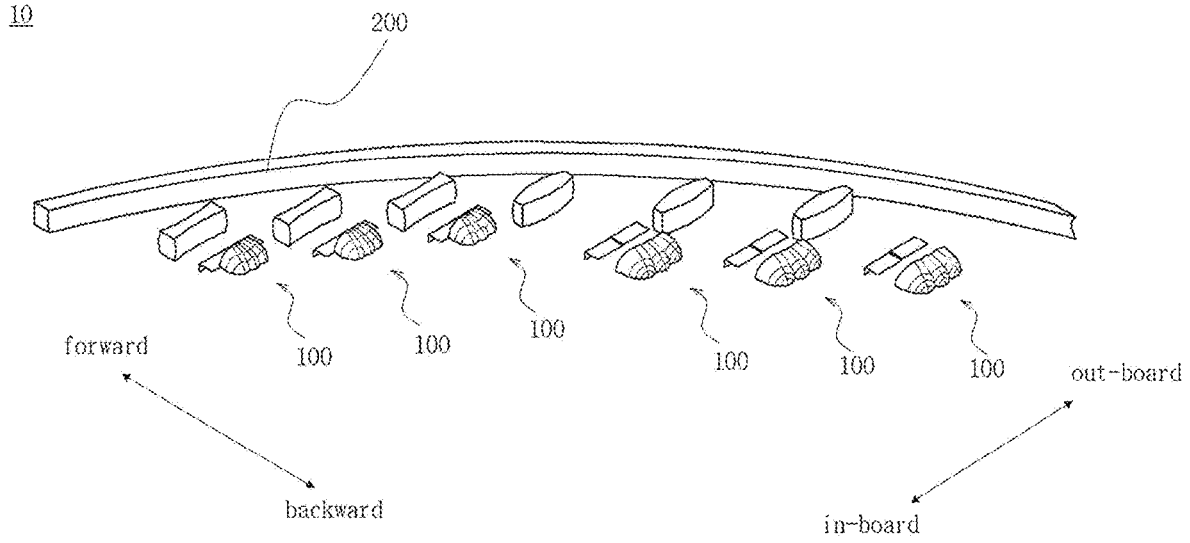
FIG. 1 is a perspective view of a vehicle lamp according to an example of the present disclosure as viewed from an upper rear.
Figure 2:
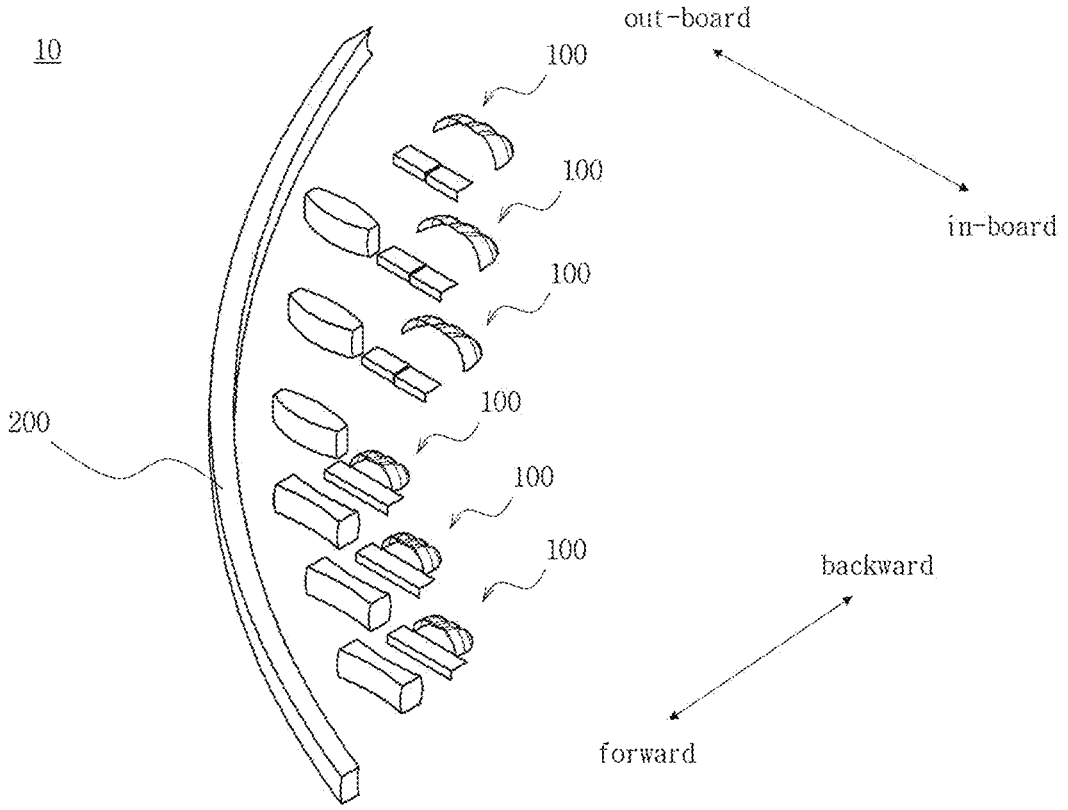
FIG. 2 is a perspective view of the vehicle lamp of FIG. 1 as viewed from an upper front.
Figure 3:
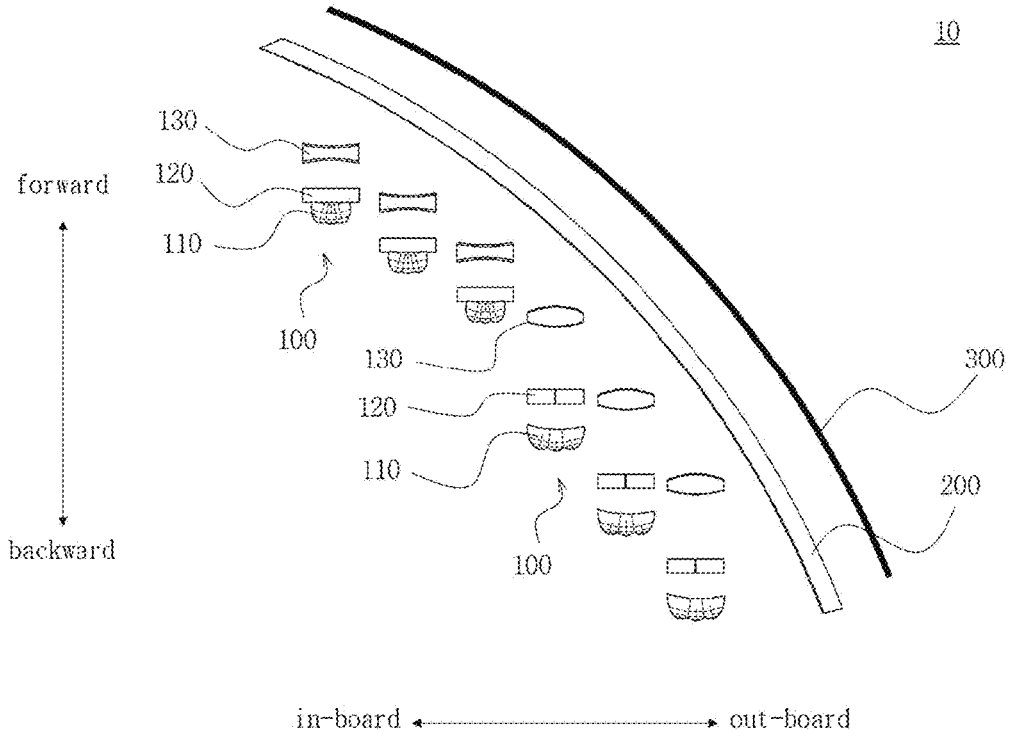
FIG. 3 is a plan view of the vehicle lamp of FIG. 1 as viewed from the top.

FIG. 1 is a perspective view of a vehicle lamp according to an example of the present disclosure as viewed from an upper rear, FIG. 2 is a perspective view of the vehicle lamp of FIG. 1 as viewed from an upper front, and FIG. 3 is a plan view of the vehicle lamp of FIG. 1 as viewed from the top. As illustrated, a vehicle lamp 10 of the present disclosure includes a plurality of optical modules 100 and a mixing lens 200, and may further include an outer lens 300. The lamp 10 of the present disclosure may be a vehicle head lamp mounted on front left and front right sides of a vehicle.

The optical module 100 is an optical structure that emits light. The lamp 10 of the present disclosure includes a plurality of optical modules 100, and each of the plurality of optical modules 100 may be arranged to be spaced apart from each other by a predetermined distance. The head lamp of the vehicle may be formed in a shape that is sharply curved rearward from an in-board side to an out-board side. By configuring the plurality of optical modules 100 each of which emits light in the shape of the head lamp, each optical module 100 may be freely arranged at an appropriate position, so an optical system may be freely configured without restrictions according to the shape of the head lamp.

Each optical module 100 may include a reflector 110, a shield 120, and a main lens 130.

The reflector 110 corresponds to a reflective structure for reflecting light irradiated from a light source accommodated therein and condensing the light to a point in front of the reflector 110. A reflective surface of the reflector 110 may be formed of one or more multi-reflection surfaces. The light source accommodated in the reflector 110 may be formed of various light emitting elements or devices, for example, LEDs, and may generate light of a single or a plurality of colors according to design specifications.

The shield 120 is arranged in front of the reflector 110 and corresponds to an optical structure that blocks some of the light reflected from the reflector 110, an end portion of the shield 120 may be configured so that a cut-off line is formed in a light distribution pattern by limiting the light irradiated from the light source, and a step structure may be formed in a central portion of the shield 120 to separate a low beam and a high beam.

The main lens 130 is a lens that is arranged in front of the shield 120 and passes light through the shield 120 to form the light distribution pattern. In the present disclosure, the main lens 130 may be formed of a concave lens or a convex lens, and details thereof will be described below.

The mixing lens 200 is a single lens that is arranged in front of the plurality of optical modules 100, and may form a light emitting image in the form of a surface light source by mixing light emitted from each of the plurality of optical modules 100. The light emitting image is a lighting image of a lamp formed on the surface of the lamp (more specifically, the surface of the outer lens) when the lamp in a lit state is viewed from the outside. The lamp 10 of the present disclosure may mix light emitted from each optical module through the mixing lens 200 to uniformly emit the light to the entire area of the surface of the outer lens, thereby forming a continuous light emitting image without a sense of disconnection.

That is, as described above, the present disclosure has a structure in which the plurality of optical modules 100 are separated from each other, and thus, the light emitting image may be formed non-uniformly due to a spaced distance between the optical modules 100. The present disclosure may obtain the light emitting image in the form of the surface light source by providing the mixing lens 200 for mixing the light emitted from each optical module 100 in front of the optical modules 100. More specifically, the mixing lens 200 may serve to make the distribution of the light emitted from the main lens 130 of each optical module 100 uniform, so that when the lamp is viewed from the outside, the light emitting image in the form of the uniform surface light source is visible. To this end, a micro pattern may be formed on an exit surface of the mixing lens 200.

The outer lens 300 is a kind of protective lens arranged in front of the mixing lens 200 and may be made of a transparent material having a predetermined thickness and curvature, for example, polycarbonate (PC). The overall shape of the outer lens 300 may correspond to the overall shape of the mixing lens 200. More specifically, the mixing lens 200 may be designed to correspond to the shape or curvature of the outer lens 300 in the horizontal direction, and thus, a curvature of an entrance surface, i.e., a rear surface, of the outer lens 300 and a curvature of an exit surface, i.e., a front surface, of the mixing lens 200 may be formed to be substantially the same.

Although the outer lens 300 is illustrated as being spaced apart from the mixing lens 200 by a predetermined distance, the outer lens 300 may be arranged to be in close contact with the mixing lens 200. Furthermore, the outer lens 300 and the mixing lens 200 may be integrally configured. As the outer lens 300 is provided, the optical structures arranged therein, that is, the mixing lens 200 and the plurality of optical modules 100 may be separated from the outside and protected from the outside.

The lamp 10 of the present disclosure may have a slim and elongated shape in the form of a straight line in the horizontal direction, and in response to this, the outer lens 300 and the mixing lens 200 may also have a slim and elongated shape. In addition, each of the plurality of optical modules 100 may have the same height as the outer lens 300 and the mixing lens 200 and may be arranged in parallel from the in-board to the out-board direction.

Hereinafter, the mixing lens 200 will be described in detail.

Figure 4:
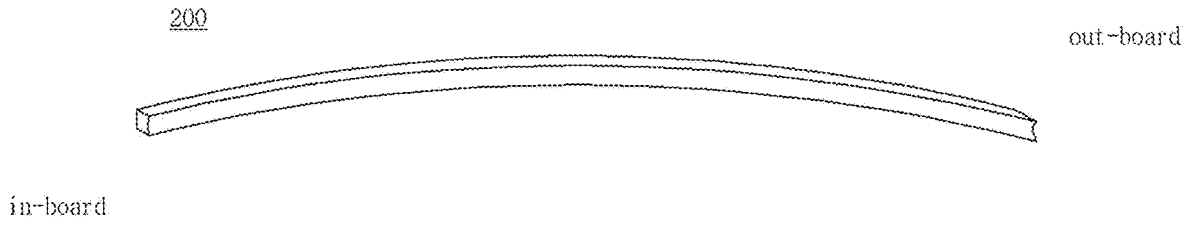
FIG. 4 is a perspective view of a mixing lens as viewed from the rear.

FIG. 4 is a perspective view of the mixing lens as viewed from the rear. As illustrated, the mixing lens 200 may be curved backward from the in-board side along the out-board side as viewed from the top. This corresponds to a curvature of a vehicle body, and may be in a form in which the curvature increases from the in-board side to the out-board side, and may be in a form in which it is sharply bent at an end portion of the out-board side.

As described above, the mixing lens of the present disclosure may be bent backward from the in-board side along the out-board side. In order to satisfy the desired optical performance and light emitting image, it is necessary to optically correct the lens bending. Accordingly, the mixing lens 200 of the present disclosure may be configured so that the light passing through the mixing lens 200 is incident on the main lens 130 of the optical module as parallel light in both the horizontal and vertical directions of the mixing lens 200. That is, the mixing lens 200 may be configured so that the optical paths of the light passing through the mixing lens 200 are parallel in the entire area in the horizontal direction, and at the same time, the optical paths of the light passing through the mixing lens 200 are parallel in the entire area in the vertical direction.

Figure 5:
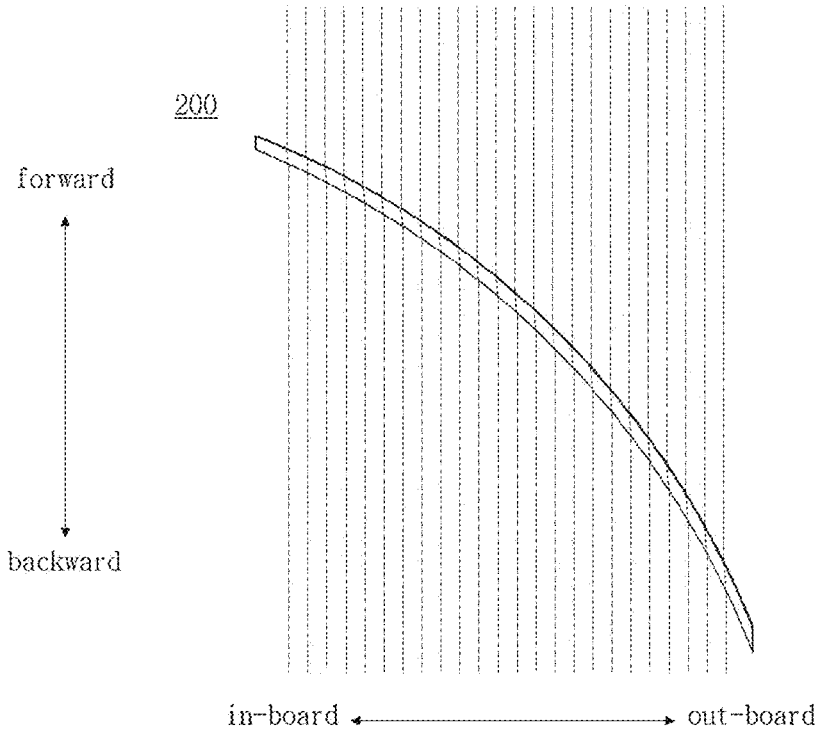
FIG. 5 is a diagram illustrating an optical path of light passing through a mixing lens in a horizontal direction.

FIG. 5 is a diagram illustrating the optical path of the light passing through the mixing lens in the horizontal direction, and as illustrated, the optical paths of the light passing through the mixing lens 200 may be substantially parallel in the entire area of the mixing lens 200 in the horizontal direction. More specifically, an emission angle of the light passing through the mixing lens 200 may be formed within 3° of an incident angle of the light incident on the mixing lens 200, more preferably within 2°, and more preferably within 1°. Accordingly, the light passing through the mixing lens 200 may be parallel light within 1° in the entire area in the horizontal direction.

Figure 6:
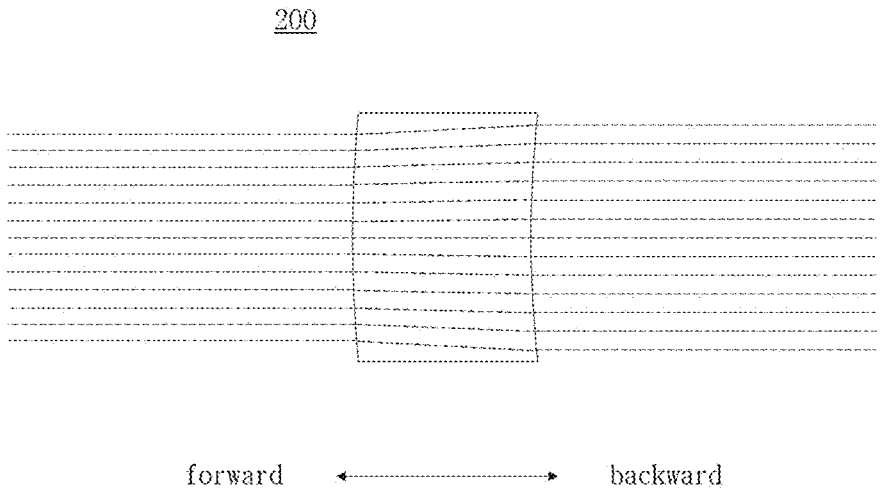
FIG. 6 is a diagram illustrating the optical path of light passing through the mixing lens in a vertical direction.

FIG. 6 is a diagram illustrating the optical path of the light passing through the mixing lens in the vertical direction, and illustrates a cross section of the mixing lens at one point. As illustrated, the optical path of the light passing through the mixing lens 200 may be substantially parallel in the entire area of the mixing lens 200 in the vertical direction. More specifically, an emission angle of the light passing through the mixing lens 200 may be formed within 3° of an incident angle of the light incident on the mixing lens 200, more preferably within 2°, and more preferably within 1°. Accordingly, the light passing through the mixing lens 200 may be parallel light within 1° in the entire area in the vertical direction.

Figure 7:
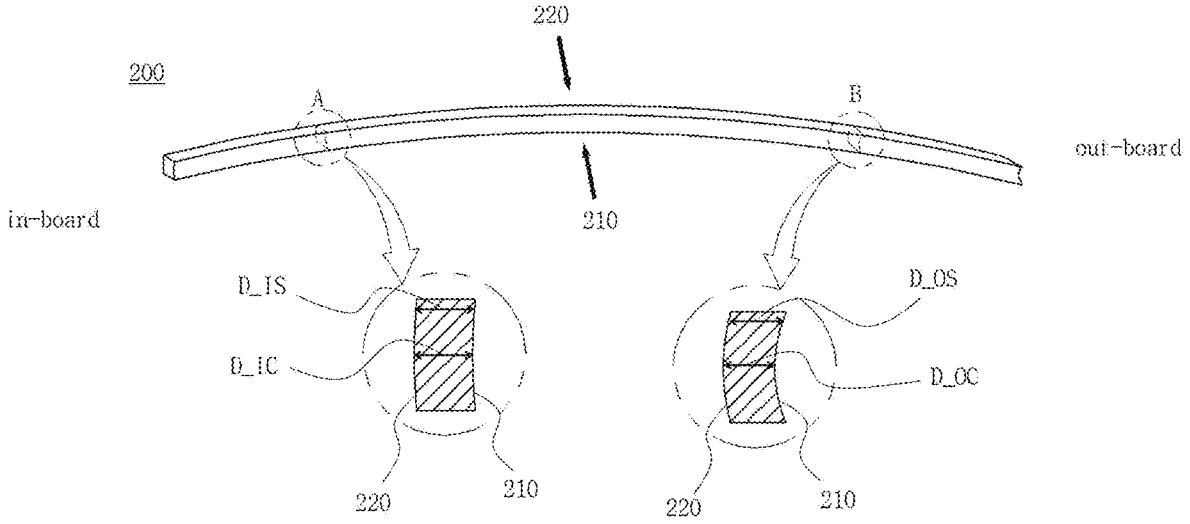
FIG. 7 is a diagram illustrating a mixing lens and cross-section A and cross-section B at a certain point together.

FIG. 7 is a diagram illustrating the mixing lens and cross section A and cross section B at a certain point together. The mixing lens 200 includes an entrance surface 210 on which the light emitted from the optical module is incident and an exit surface 220 through which the light passing through the mixing lens 200 is emitted. The entrance surface 210 may be concave and the exit surface 220 may be convex.

In FIG. 7, cross section A corresponds to the cross section on the in-board side, cross section B corresponds to the cross section on the out-board side. In FIG. 7, D-IC refers to a thickness of a central portion of cross section A on the in-board side, and D_IS refers to a thickness of a side portion of the cross section A on the in-board side, D_OC refers to a thickness of the central portion of the cross section B on the out-board side, and D_IS refers to a thickness of the side portion of the cross-section B on the out-board side. In the cross section of the mixing lens, the D_IS and D_OS may correspond to the same position. That is, a distance from the D_IC to the D_IS and a distance from the D_OC to the D_OS may be the same. The cross section A and cross section B are relative points for distinguishing the in-board side and the out-board side. When any two points are selected in the mixing lens 200, in FIG. 7, the point on the left may correspond to the cross section A and the point on the right may correspond to the cross section B.

In this case, in order for the optical paths of the light passing through the mixing lens 200 to be parallel in the entire area in the horizontal direction, the mixing lens 200 may be configured so that the thickness decreases from the in-board side to the out-board side, and the curvature of the entrance surface 210 and the curvature of the exit surface 220 increase.

Specifically, since the thickness of the mixing lens 200 decreases from the in-board side to the out-board side, the thickness of D_OC of the B cross-section on the out-board side may be configured to be smaller than the D_IC of the cross section A on the in-board side, and the thickness of the D_OS of the cross section B on the out-board side B may be configured to be smaller than that of D_IS of the cross-section A on the in-board side. In addition, since the curvatures of the entrance surface 210 and the exit surface 220 increase from the in-board side to the out-board side, the curvature of the entrance surface 210 of the cross section B on the out-board side may be formed to be larger than that of the entrance surface 210 of the in-board side, and at the same time, the curvature of the exit surface 220 of the cross section B on the out-board side may be formed to be larger than that of the exit surface 220 of the cross section A on the in-board side. In this case, the difference in the curvature between the D_IS and the D_IC of the cross section B on the out-board side may be formed to be larger than the difference in the curvature between the D_IS and the D_IC of the cross section A on the in-board side, the difference between the curvature of the entrance surface and the exit surface of the outermost section on the in-board side and the entrance surface and the exit surface of the outermost cross section on the out-board side may be formed to be largest, and the entrance surface and the exit surface of the outermost cross section on the in-board side may have a relatively small curvature and formed to be relatively flat.

In order for the optical path of the light passing through the mixing lens 200 to be parallel in the entire area in the vertical direction, the mixing lens 200 may be configured so that the curvature of the entrance surface 210 at all positions is larger than that of the exit surface 220. Specifically, the curvature of the entrance surface 210 of the cross-section A on the in-board side may be formed to be larger than that of the exit surface 220. Similarly, the curvature of the entrance surface 210 of the cross-section B on the out-board side may be formed to be larger than that of the exit surface 220. In this way, the curvature of the entrance surface 210 at any point in all positions of the mixing lens 200 may be formed to be larger than the curvature of the exit surface 220.

By configuring the mixing lens in this way, even though the mixing lens has a curved shape, the correction for optical bending may be performed, and thus, the light passing through the mixing lens may be maintained as parallel light. As a result, the optical path of the light emitted from the main lens and incident on the mixing lens may be configured in parallel, which may help to create a clearer light emitting image in the form of the surface light source.

Hereinafter, the optical module 100 and the mixing lens 200 will be described in detail.

Figure 8:
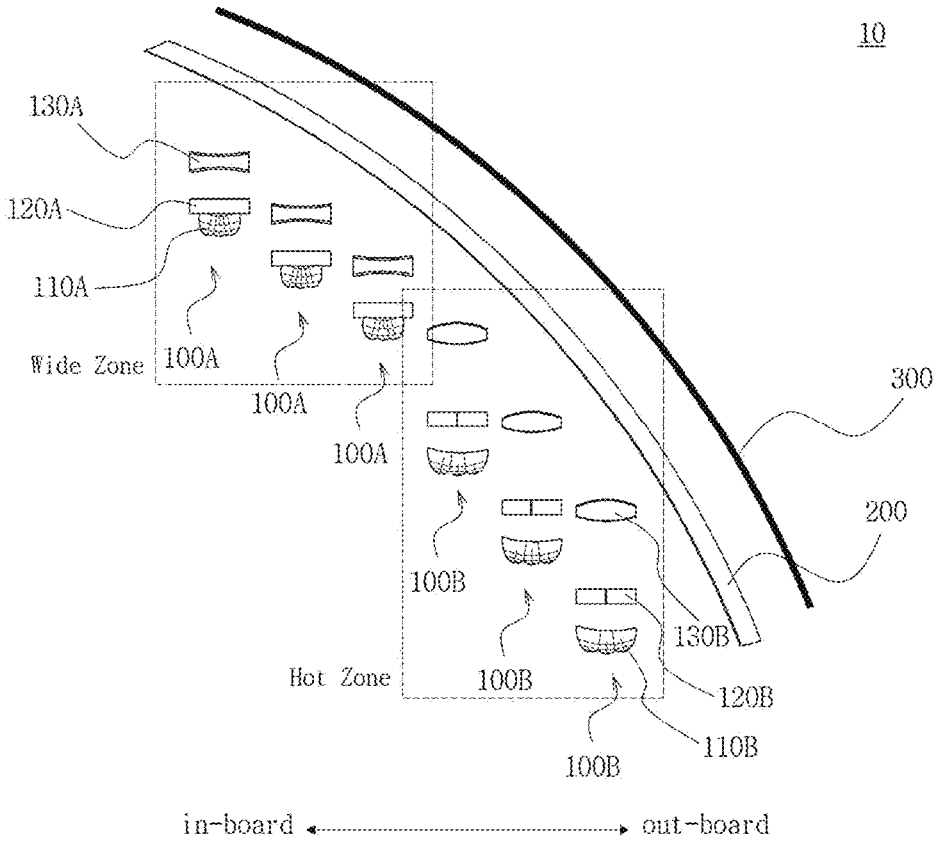
FIG. 8 is a diagram illustrating FIG. 3 again.

FIG. 8 is a diagram illustrating FIG. 3 again. As illustrated, the plurality of optical modules 100 include a first optical module 100A and a second optical module 100B, and each of the first optical module 100A and the second optical module 100B may be provided in plurality. The first optical modules 100A may be arranged on the in-board side in parallel and continuously, and the second optical modules 200B may be arranged in parallel on the out-board side in parallel and continuously.

Figure 9A:
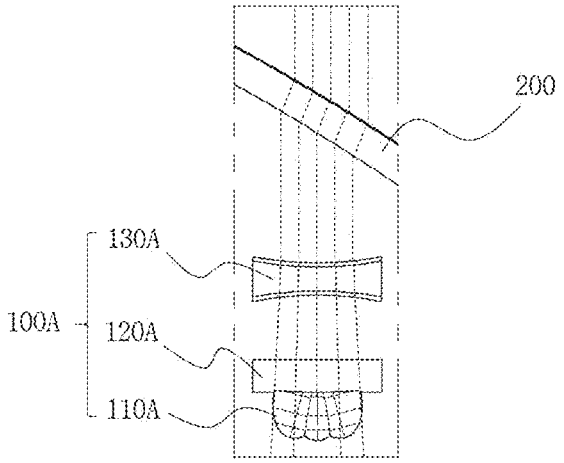
FIGS. 9A and 9B are diagrams for describing a first optical module and a second optical module.
Figure 9B:
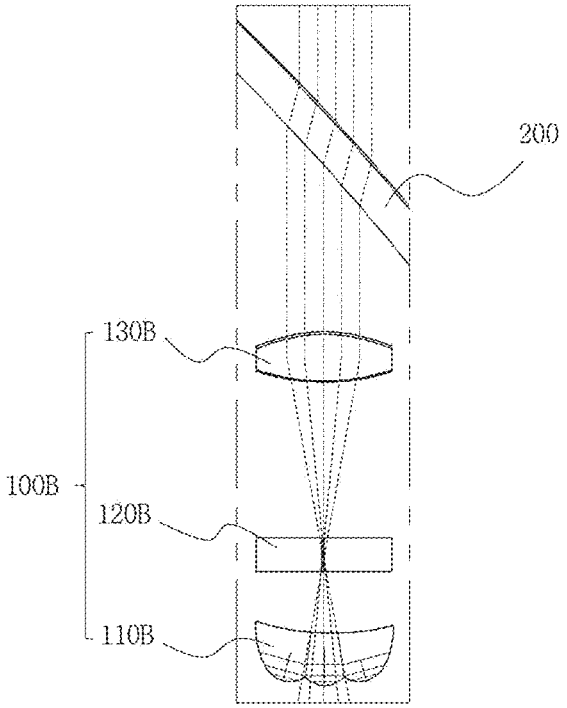

FIGS. 9A and 9B are diagrams for describing the first optical module and the second optical module. FIG. 9A illustrates one first optical module 100A, and the first optical module 100A may include a reflector 110A, a shield 120A, and a main lens 130A. FIG. 9B illustrates one second optical module 100B, and the second optical module 100B may include a reflector 110B, a shield 120B, and a main lens 130B. Here, each of the first optical modules 100A has the same structure. That is, the reflector 110A, the shield 120A, and the main lens 130A constituting each of the first optical modules 100A are designed to have the same shape, and each of the second optical modules 100B has the same structure. That is, the reflector 110B, the shield 120B, and the main lens 130B constituting each of the second optical modules 100B are designed to have the same shape.

The dotted line illustrated in FIGS. 9A and 9B is for describing the focus of the main lens 130. When parallel light is incident from the mixing lens 200 toward the main lens 130, the parallel light may correspond to the optical path of the corresponding parallel light.

The main difference between the first optical module 100A and the second optical module 100B is the main lens. The main lens 130A of the first optical module 100A and the main lens 130B of the second optical module 100B may be formed of different types of lenses. More specifically, the main lens 110A of the first optical module may be formed of a concave lens, and the main lens 100B of the second optical module may be formed of a convex lens.

Referring back to FIGS. 8 and 9A and 9B, a certain area on the in-board side is called a wide zone, and a certain area on the out-board side is called a hot zone. In this case, the first optical modules 100A may be arranged in the wide zone and the second optical modules 100B may be arranged in the hot zone. The first optical module 100A arranged in the wide zone has an imaginary focus by forming the main lens 130A as the concave lens and has an imaginary focus, so the light emitted from the main lens 130A of the first optical module 100A is widely diffused toward the mixing lens 200, and the second optical module 100B arranged in the hot zone has a single focus by forming the main lens 130B as the convex lens, so the light emitted from the main lens 130B of the second optical module 100B may proceed in parallel toward the mixing lens 200.

Figure 10A:
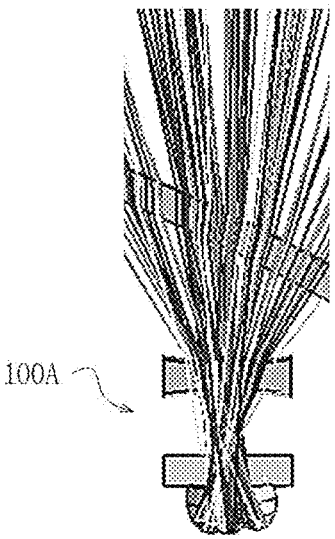
FIGS. 10A and 10B are diagrams illustrating an actual optical path of light emitted from an optical module.
Figure 10B:
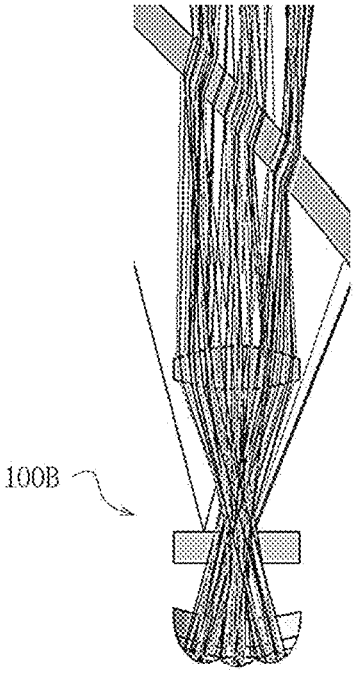

FIGS. 10A and 10B are diagrams illustrating an actual optical path of light emitted from the optical module. As illustrated in FIG. 10A, it may be confirmed that the light emitted from the first optical module 100A is widely diffused toward the mixing lens 200 by the first main lens 130A that is the concave lens, and the light emitted from the second optical module 100B proceeds in parallel toward the mixing lens 200 by the second main lens 130B which is the convex lens.

In this way, by appropriately arranging and designing the optical modules formed of different types of main lenses in the wide zone on the in-board side and the hot zone on the out-board side corresponding to the bent shape of the mixing lens, it is possible to minimize the distortion of the light distribution image due to aberration caused by the lens bending.

Figure 11A:
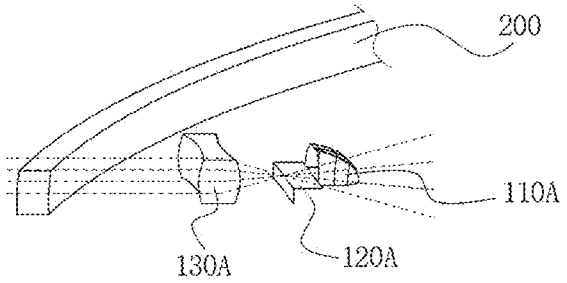
FIGS. 11A and 11B are diagrams for describing a horizontal focus and a vertical focus of the first optical module.
Figure 11B:
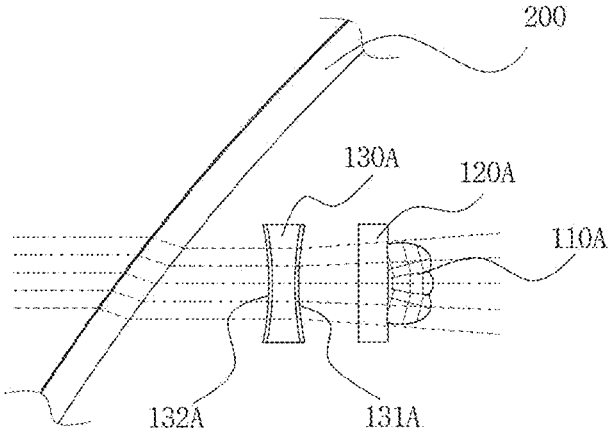

FIGS. 11A and 11B are diagrams for describing a horizontal focus and a vertical focus of the first optical module. FIG. 11A is a perspective view of the first optical module as viewed from the side and FIG. 11B is a plan view of the first optical module as viewed from the top. As illustrated, the main lens 130A of the first optical module 100A may be configured so that an entrance surface 131A and an exit surface 132A may each be concave in a horizontal direction and convex in a vertical direction. Accordingly, the vertical focus of the main lens 130A as illustrated in FIG. 11A may be formed as a single focus, and the horizontal focus of the main lens 130A as illustrated in FIG. 11B may be formed as an imaginary focus. In this case, the shield 120A of the first optical module 100A may be arranged at the vertical focal position of the main lens 130A of the first optical module 100A.

Figure 12A:
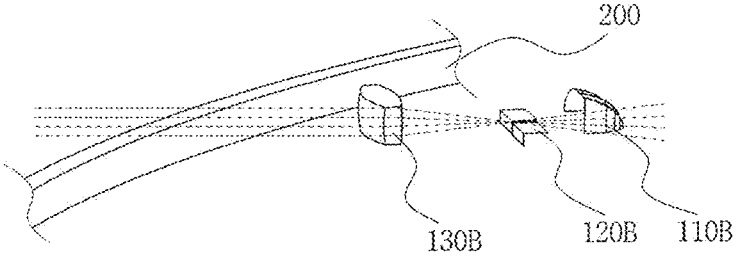
FIGS. 12A and 12B are diagrams for describing a horizontal focus and a vertical focus of the second optical module.
Figure 12B:
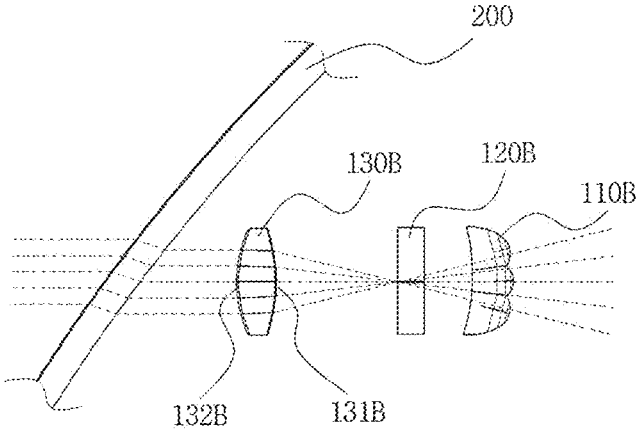

FIGS. 12A and 12B are diagrams for describing a horizontal focus and a vertical focus of the second optical module. FIG. 12A is a perspective view of the second optical module as viewed from the side and FIG. 12B is a plan view of the second optical module as viewed from the top. As illustrated, the main lens 130B of the second optical module 100B may be configured so that an entrance surface 131B and an exit surface 132B may each be convex in both the horizontal direction and vertical direction. Accordingly, the vertical focus of the main lens 130B as illustrated in FIG. 12A may be formed as a single focus, and the horizontal focus of the main lens 130B as illustrated in FIG. 12B may be formed as a single focus. In this case, the vertical focus and the horizontal focus of the main lens 130B of the second optical module 100B may be formed at the same position, and the shield 120B of the second optical module 100B may be configured to be arranged at the corresponding focal position.

With this configuration, as illustrated in FIG. 10, the light emitted from the main lens of the first optical module is widely diffused toward the mixing lens, and the light emitted from the main lens of the second optical module proceeds in parallel toward the mixing lens, so light may be uniformly distributed from the main lenses of the in-board side having a relatively small degree of bending and the out-board side having a relatively large degree of bending. As a result, the light emitting image of the light passing through the mixing lens may be formed in the form of a clear surface light source.

Figure 13:
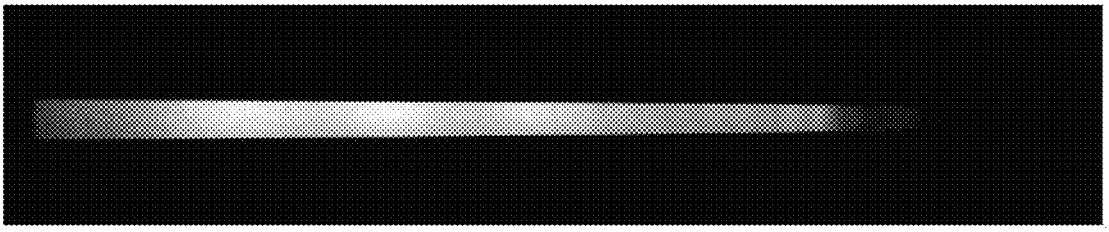
FIG. 13 is a diagram illustrating a light emitting image according to a VE simulation result of a head lamp of the present disclosure.

FIG. 13 is a diagram illustrating a light emitting image according to a VE simulation result of the head lamp of the present disclosure. As illustrated, it may be confirmed that the light emitting image in the form of the uniform surface light source is realized.

On the other hand, as Comparative Example, the experimental results for the case where the optical module formed of the convex lens rather than the optical module formed of the concave lens is arranged in the wide zone are as follows. Referring back to FIG. 8, in the present disclosure, the first optical module formed of the concave lens is arranged in the wide zone and the second optical module formed of the convex lens are arranged in the hot zone, whereas in Comparative Example, the optical module formed of the convex lens is arranged in both the wide zone and hot zone.

More specifically, in the case of Comparative Example, an anamorphic lens which is a convex lens was arranged in the wide zone and a single focus lens which is a convex lens was arranged in the hot zone.

Figure 14:
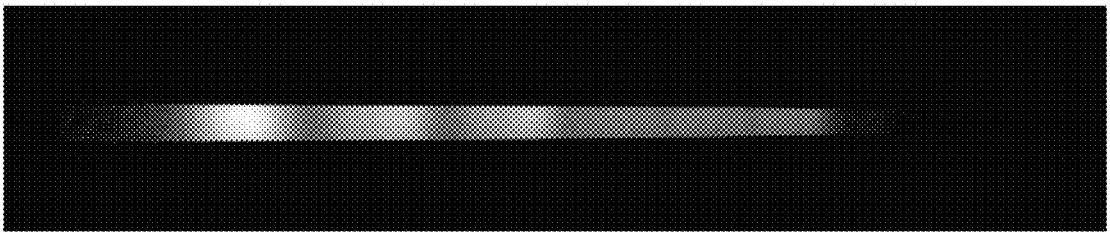
FIG. 14 is a diagram illustrating a light emitting image according to a VE simulation result of a head lamp of Comparative Example.

FIG. 14 illustrates a light emitting image according to a VE simulation result of the head lamp of Comparative Example. As illustrated, it may be confirmed that the uniform light emitting image is realized.

As described above, in the present disclosure, in the design shape of the head lamp that is sharply bent to the rear as it progresses from the in-board side to the out-board side along the curvature of the vehicle body while being slim, in order to provide the head lamp in which the light emitting image of the lamp is uniformly formed as a whole to be formed in the form of the surface light source, the light source includes a plurality of optical modules. In this case, the optical module of the concave lens is arranged in the wide zone of the in-board side and the optical module of the convex lens is arranged in the hot zone of the out-board side, and the mixing lens for mixing light is installed in front of the plurality of optical modules and between the optical modules and the outer lens, thereby realizing the desired optical performance, the lamp design, and the light emitting image.

As set forth above, according to an exemplary embodiment of the present disclosure, it is possible to freely design an optical system without restrictions according to a shape of a lamp and realize a uniform light emitting image in a form of a surface light source by including a plurality of optical modules and a mixing lens for mixing light emitted from each optical module in front of the plurality of optical modules.

Although embodiments of the present disclosure have been hereinabove described with reference to the accompanying drawings, those skilled in the art to which the present disclosure pertains will be able to understand that the present disclosure may be implemented in other specific forms without departing from the spirit or essential feature of the present disclosure. Therefore, it is to be understood that exemplary embodiments described above are illustrative rather than being restrictive in all aspects.

What is claimed is:

1. A vehicle lamp, comprising:

a plurality of optical modules each emitting light and spaced apart from each other, wherein the plurality of optical modules includes:

at least one first optical module;

at least one second optical module;

a main lens of the first optical module; and a main lens of the second optical module;

wherein the main lens of the first optical module and the main lens of the second optical module are formed of different types of lenses; and a mixing lens arranged in front of the plurality of optical modules and mixing the light emitted from each of the plurality of optical modules to form a light emitting image as a surface light source, wherein the mixing lens is curved backward from an in-board side of a vehicle along an out-board side of the vehicle.

2. The vehicle lamp of claim 1, wherein a curvature of the mixing lens increases from the in-board side of the vehicle to the out-board side of the vehicle.

3. The vehicle lamp of claim 1, wherein the mixing lens is configured such that light passing through the mixing lens becomes parallel light within 1° an incident angle in an entire area in a horizontal direction relative to the mixing lens.

4. The vehicle lamp of claim 3, wherein in the mixing lens, an entrance surface on which the light emitted from the optical module is incident is formed to be concave, and an exit surface on which the light passing through the mixing lens is emitted is formed to be convex, and a thickness of the mixing lens decreases from the in-board side to the out-board side, and a curvature of the entrance surface and a curvature of the exit surface increase from the in-board side to the out-board side.

5. The vehicle lamp of claim 1, wherein the mixing lens is configured such that light passing through the mixing lens becomes parallel light within 1° an incident angle in an entire area in a vertical direction.

6. The vehicle lamp of claim 5, wherein in the mixing lens, an entrance surface on which the light emitted from the optical module is incident is formed to be concave, and an exit surface on which the light passing through the mixing lens is emitted is formed to be convex, and in the mixing lens, a curvature of the entrance surface is larger than that of the exit surface at all positions.

7. The vehicle lamp of claim 1, wherein the first optical module is arranged on the in-board side, and the second optical module is arranged on the out-board side, and the main lens of the first optical module is a concave lens, and the main lens of the second optical module is a convex lens.

8. The vehicle lamp of claim 7, wherein in the main lens of the first optical module, an entrance surface and an exit surface are concave in a horizontal direction and convex in a vertical direction, and in the main lens of the second optical module, an entrance surface and an exit surface are convex in a horizontal direction and convex in a vertical direction.

9. The vehicle lamp of claim 8, wherein a shield of the first optical module is positioned at a vertical focus position of the main lens of the first optical module.

10. The vehicle lamp of claim 8, wherein a horizontal focus and a vertical focus of the main lens of the second optical module are formed at a same position.

11. The vehicle lamp of claim 10, wherein a shield of the second optical module is positioned at a horizontal focus position or a vertical focus position of the main lens of the second optical module.

12. The vehicle lamp of claim 1, wherein the mixing lens is a single lens.

13. The vehicle lamp of claim 1, further comprising:

an outer lens arranged in front of the mixing lens, wherein a curvature of an entrance surface of the outer lens is formed to be a same as that of an exit surface of the mixing lens.

* * * * *